US008922470B2

(12) United States Patent
Noda

(10) Patent No.: US 8,922,470 B2
(45) Date of Patent: Dec. 30, 2014

(54) LIQUID CRYSTAL DISPLAY APPARATUS WITH ROW COUNTER ELECTRODES AND DRIVING METHOD THEREFOR

(75) Inventor: Kazuhiro Noda, Tokyo (JP)

(73) Assignee: Sony Corporation, Tokyo (JP)

( * ) Notice: Subject to any disclaimer, the term of this patent is extended or adjusted under 35 U.S.C. 154(b) by 89 days.

(21) Appl. No.: 13/292,767

(22) Filed: Nov. 9, 2011

(65) Prior Publication Data

US 2012/0050243 A1 Mar. 1, 2012

Related U.S. Application Data

(63) Continuation of application No. 10/911,546, filed on Aug. 5, 2004.

(30) Foreign Application Priority Data

Aug. 11, 2003 (JP) ..... 2003-291414

(51) Int. Cl.
*G09G 3/36* (2006.01)

(52) U.S. Cl.
CPC ..... *G09G 3/3655* (2013.01); *G09G 3/3614* (2013.01)
USPC ..... 345/96

(58) Field of Classification Search
CPC ..... G09G 3/3655; G09G 3/3614
USPC ..... 345/92, 96, 98–100
See application file for complete search history.

(56) References Cited

U.S. PATENT DOCUMENTS

| | | | | |
|---|---|---|---|---|
| 4,455,576 | A | 6/1984 | Hoshi | |
| 5,173,687 | A | 12/1992 | Tanaka et al. | |
| 5,627,560 | A | 5/1997 | Verhulst | |
| 6,229,512 | B1 * | 5/2001 | Shigehiro | 345/98 |
| 6,433,764 | B1 | 8/2002 | Hebiguchi et al. | |
| 6,483,494 | B1 * | 11/2002 | Liaw et al. | 345/100 |
| 6,577,293 | B1 * | 6/2003 | Kwon | 345/89 |
| 6,958,744 | B2 | 10/2005 | Nakamura | |
| 2002/0135574 | A1 | 9/2002 | Nakamura | |
| 2003/0095091 | A1 * | 5/2003 | Enomoto et al. | 345/87 |
| 2004/0178977 | A1 | 9/2004 | Nakayoshi et al. | |
| 2005/0052385 | A1 | 3/2005 | Noda | |

FOREIGN PATENT DOCUMENTS

| | | |
|---|---|---|
| JP | 63-82228 | 5/1988 |
| JP | 02-157815 | 6/1990 |
| JP | 02-312466 | 12/1990 |

(Continued)

OTHER PUBLICATIONS

Japanese Office Action: Application No. 2003-291414: Dated: Mar. 27, 2007.

*Primary Examiner* — Allison Johnson
(74) *Attorney, Agent, or Firm* — Rader, Fishman & Grauer PLLC

(57) ABSTRACT

A display apparatus includes pixel electrodes, a counter electrode arranged facing the pixel electrodes, and liquid crystal cells held in a space between the pixel electrodes and the counter electrode. The optical characteristics of the liquid crystal cells change based on potential differences between the pixel electrodes and the counter electrode. The counter electrode includes row counter electrodes divided in accordance with rows of pixels. The display apparatus also includes a counter scanning circuit for sequentially scanning the row counter electrodes in accordance with a pixel row sequentially selected by a vertical scanning circuit and for applying a counter potential of one inverting polarity.

15 Claims, 7 Drawing Sheets

(56) References Cited

FOREIGN PATENT DOCUMENTS

| | | |
|---|---|---|
| JP | 05-241124 | 9/1993 |
| JP | 07-104246 | 4/1995 |
| JP | 08-298638 | 11/1996 |
| JP | 09-134152 | 5/1997 |
| JP | 11-044891 | 2/1999 |
| JP | 2002-107693 | 4/2002 |
| JP | 2002-311926 | 10/2002 |
| JP | 2003-005151 | 1/2003 |
| WO | WO-0235282 A1 | 5/2002 |

* cited by examiner

LIQUID CRYSTAL DISPLAY APPARATUS WITH ROW COUNTER ELECTRODES AND DRIVING METHOD THEREFOR

CROSS REFERENCES TO RELATED APPLICATIONS

This is a continuation of application Ser. No. 10/911,546, filed Aug. 5, 2001. The present application claims priority based on Japanese Patent Application No. 2003-291414, filed Aug. 11, 2004, the entirety of which being incorporated herein by reference.

BACKGROUND OF THE INVENTION

1. Field of the Invention

The present invention relates to active matrix display apparatuses having a flat panel structure, typified by liquid crystal displays (LCDs), and driving methods for the display apparatuses. More particularly, it relates to a configuration of a counter electrode that faces pixel electrodes integratedly formed in a matrix form and a driving method for the counter electrode.

2. Description of the Related Art

FIG. 6 is a circuit block diagram schematically showing an example of a known display apparatus. Referring to FIG. 6, the display apparatus basically includes a pixel array unit 1, vertical direction shift registers 2*a*, and a horizontal direction shift register 3*a*. The pixel array unit 1 includes scanning lines X arranged in rows, signal lines Y arranged in columns, and pixels 5 arranged in a matrix form in association with intersections of the scanning lines X and the signal lines Y. The vertical direction shift registers 2*a* are arranged at the left and right of the pixel array unit 1 to drive the pixel array unit 1 from the left and right at the same time. More specifically, the vertical direction shift registers 2*a* sequentially apply selection pulses to the scanning lines X so as to sequentially select pixels 5 row by row. The horizontal direction shift register 3*a* applies a video signal VIDEO whose polarity inverts between positive and negative with respect to a predetermined reference potential COM to each of the signal lines Y, and writes the signal VIDEO whose polarity is positive or negative in the pixels 5 in a selected row. More specifically, the horizontal direction shift register 3*a* sequentially opens and closes a horizontal switch HSW connected to an upper end of each of the signal lines Y. The horizontal switch HSW connects each of the signal lines Y to a common video line 3*b*. The video signal VIDEO is externally supplied to the video line 3*b*. The horizontal direction shift register 3*a* sequentially opens and closes the horizontal switch HSW to sample the signal VIDEO at each of the signal lines Y.

Each of the pixels 5 includes a switching element composed of a transistor Tr; and a pixel electrode 5*a*. The transistor Tr is connected to the corresponding scanning line X and signal line Y and is switched on in accordance with a selection pulse. A signal VIDEO is written in the pixel electrode 5*a* via the switched-on transistor Tr. The signal VIDEO is sampled at the signal line Y by the horizontal direction shift register 3*a*. Furthermore, a counter electrode 21 is arranged facing the pixel electrode 5*a* with a predetermined space therebetween. The counter electrode 21 is common for all the pixel electrodes 5*a*. For example, liquid crystal functioning as an electro-optic material is held between the counter electrode 21 and the pixel electrode 5*a*, and a liquid crystal cell LC is formed for each pixel. The optical characteristics of the liquid crystal cell LC changes based on a potential difference between the pixel electrode 5*a* and the counter electrode 21, so that desired image display is performed. Each of the pixels 5 further includes an auxiliary capacitor Cs for holding a signal written in the pixel electrode 5*a*. One electrode of the auxiliary capacitor Cs is connected to a corresponding transistor Tr, and the other electrode of the auxiliary capacitors Cs is fixed to a reference potential COM via an auxiliary capacitor line Xcs. The counter electrode 21 is also fixed to the same reference potential COM.

FIG. 7 is a schematic diagram showing a driving method for the display apparatus shown in FIG. 6. A so-called 1 H inversion driving method and a so-called 1 F inversion driving method are adopted. The active matrix display apparatus has a flat panel structure and includes a pixel substrate 10 and a counter substrate 20 joined together with a predetermined space therebetween. For example, liquid crystal functioning as an electro-optic material is held in the space between the pixel substrate 10 and the counter substrate 20. The pixel electrodes 5*a* are arranged in a matrix form on the pixel substrate 10. For simpler explanation, the pixel array unit 1 is shown by 4×5 pixels. In contrast, the counter electrode 21 is arranged as one solid unit over the counter substrate 20. The counter electrode 21 is fixed at the predetermined reference potential COM, for example, COM=7.5 V.

In the first field, at the first horizontal period, a high (H) signal with respect to the reference potential COM is written in pixels in the first row. This signal level is, for example, 12.5 to 7.5 V. At the next horizontal period, a signal whose polarity is inverted to low (L) is written in pixels in the second row. The level of the low signal is 2.5 to 7.5 V. Since the polarity of a signal written in a pixel row inverts horizontal period by horizontal period (1H), as described above, this method is called 1 H inversion driving. Similarly, 1 H inversion driving is performed in the second field. However, when attention is focused on a pixel row, the polarity of the signal written in the first field is different from the polarity of the signal written in the second field. For example, when attention is focused on pixels in the first row, a signal at H level is written in the first field, and in contrast, a signal at L level is written in the second field. Accordingly, since the polarity of a signal written in pixels is inverted field by field (1 F), this method is called 1 F inversion driving.

Such active matrix display apparatus driving methods are disclosed, for example, in Japanese Unexamined Patent Application Publication No. 2002-107693 and Japanese Unexamined Patent Application Publication No. 2003-5151.

As shown in FIG. 7, in the known display apparatus, the counter substrate 20 has a common potential and a solid structure. On the pixel substrate 10, in the first field, a signal potential inverts row by row, such as H, L, H, and L, and in the second field, the phase is inverted and a signal potential inverts row by row, such as L, H, L, and H, so that trouble in image quality, such as flickering, can be prevented. However, in 1 H inversion driving, the polarity of a signal potential in the first row is opposite to the polarity of a signal potential in the second row. Thus, for example, when the signal amplitude is 5.0 V, a potential difference of at most 10.0 V generates in a space (a) between the pixels. In contrast, a voltage of at most 5.0 V is applied between the pixel substrate 10 and the counter substrate 20. For example, assuming that the space between the pixel substrate 10 and the counter substrate 20 is approximately 3 μm, even if the size of the space (a) between the pixels is 3 μm, the electric field intensity between the pixels is approximately twice the counter substrate 20. Thus, orientation of liquid crystal at an end of a pixel electrode is disordered. In order to conceal the orientation disorder, a light-shielded area, such as a black mask, must be enlarged. However, this causes a reduction in the pixel opening ratio.

This tendency has a larger influence due to an increase in the density of pixels. Thus, in the current situation, a phenomenon (hysteresis) in which liquid crystal molecules are displaced too far to return to the original due to a lateral electric field between pixels occurs. As described above, an increase in the density of pixels causes a problem, such as orientation disorder due to a lateral electric field between the pixels. This is because a lateral electric field between adjacent pixels is stronger than a vertical electric field between a pixel substrate and a counter electrode. As a result of this, problems, such as a reduction in the contrast due to orientation disorder, a reduction in the transmittance due to an increase in a light-shielded area to conceal the orientation disorder, hysteresis of liquid crystal molecules due to local concentration of an electric field, and the like occur. In accordance with an increase in the density, reducing the intensity in an electric field between adjacent pixels is becoming a more important issue.

In accordance with an increase in the signal amplitude, the intensity of an electric field operating between pixels is increased, and orientation of liquid crystal is disordered. In addition, large signal amplitude causes various problems. For example, noise caused by a signal change largely affects pixel potential via parasitic capacitance and this causes inferior image quality, such as crosstalk and blurring or ghost images when a window is displayed. Also, large signal amplitude causes a large difference between a pixel potential and a signal line potential, and significant leakage of a transistor occurs. For example, a problem, such as a reduction in the image quality due to light leakage, is caused.

In order to reduce signal amplitude by half, a VCOM inversion driving method has been proposed. This is a method for inverting a voltage VCOM applied to a counter electrode at a 1 H period and for inverting, in accordance with this, a signal potential written in a pixel electrode. In principle, VCOM inversion driving is capable of reducing signal amplitude by half compared with a case where the potential of a counter electrode is fixed. However, actually, inversion driving of a counter electrode formed as one solid unit having a large capacity at a high speed period of 1 H is difficult, and this is not practical as a solving means.

SUMMARY OF THE INVENTION

Accordingly, in order to solve the problems described above, it is an object of the present invention to provide a configuration of a counter electrode capable of reducing signal amplitude and a driving method for the counter electrode.

In order to achieve the above object, a display apparatus according to the present invention includes a pixel array unit including scanning lines arranged in rows, signal lines arranged in columns, and pixels arranged in a matrix form in association with intersections of the scanning lines and the signal lines, each of the pixels including a switching element connected to the corresponding scanning line and signal line and a pixel electrode; a vertical scanning circuit for sequentially applying a selection pulse to each of the scanning lines to sequentially select the pixels row by row; a horizontal driving circuit for applying a signal whose polarity inverts to the signal lines and for writing the signal of one polarity in the pixels in a selected row; a counter electrode arranged facing the pixel electrode with a predetermined space therebetween, the counter electrode including row counter electrodes divided based on the rows of the pixels; electro-optic materials each held in the space, the optical characteristics of the electro-optic materials changing based on a potential difference between the corresponding pixel electrode and the counter electrode; and a counter scanning circuit for sequentially scanning the row counter electrodes based on a pixel row sequentially selected by the vertical scanning circuit and for applying one of counter potentials whose polarity inverts. The switching element is turned on in accordance with the selection pulse and a signal is written in the pixel electrode via the turned-on switching element. When the horizontal driving circuit writes the signal of the one polarity to the selected pixel row, the counter scanning circuit applies the one of the counter potentials, which has an opposite polarity, to the row counter electrodes corresponding to the selected pixel row and keeps the row counter electrodes at the one of the counter potentials having the opposite polarity during a period from cancellation of selection of the pixel row to the next selection.

Preferably, the horizontal driving circuit writes the signal whose polarity inverts row by row to each pixel row, and the counter scanning circuit applies the one of the counter potentials whose polarity inverts row by row and is opposite to the signal to the row counter electrodes. Also, preferably, each of the pixels includes an auxiliary capacitor for holding the signal written in the corresponding pixel electrode, and one electrode of the auxiliary capacitor is connected to the corresponding switching element and the other electrode of the auxiliary capacitor is fixed at a predetermined reference potential.

According to the present invention, the counter electrode is not provided as one solid unit but is provided as row counter electrodes divided row by row based on rows of pixels. The row counter electrodes are scanned while a voltage having an opposite phase to a signal input voltage is applied to the row counter electrodes. Thus, a vertical electric field between a counter substrate and a pixel substrate is ensured and a lateral electric field operating between the pixels is moderated. This prevents a defect in orientation of liquid crystal due to local concentration of an electric field between pixels. Furthermore, an increase in the opening ratio, an improvement in the contrast, and prevention of hysteresis behavior in liquid crystal can be achieved. Unlike known VCOM inversion driving, the row counter electrodes divided row by row based on the rows of the pixels are scanned in the present invention. Thus, withstand pressure in a panel can be reduced and the potential of the counter substrate is DC behaved. Therefore, a simple circuit structure can be achieved.

As described above, providing the row counter electrodes arranged by dividing electrodes on the counter substrate based on the rows of the pixels on the pixel substrate and applying a predetermined potential while scanning the row counter electrodes achieve the effects described below. First, reducing the intensity of an electric field between pixels prevents a defect in orientation of liquid crystal due to disorder of an electric field and reduces a light leakage area. Second, the potential of the signal lines and the potential of the pixels can be reduced, thus enabling a total reduction in the voltage on the pixel substrate. Third, a potential difference between the potential of the signal lines and the potential of the pixels can be reduced, thus enabling a reduction in the leakage of pixel transistors. This significantly prevents an inferior image quality, such as light leakage. Fourth, the amplitude of a signal is reduced and noise inserted from the signal lines via parasitic capacitance is reduced. This significantly prevents an inferior image quality, such as crosstalk, ghost images, and blurring near a border when a window is displayed. Fifth, since a scanning potential of the row counter electrodes arranged on the counter substrate is fixed at positive or negative with respect to a reference potential, a simple circuit structure can be achieved.

DESCRIPTION OF THE PREFERRED EMBODIMENTS

Figure 1:
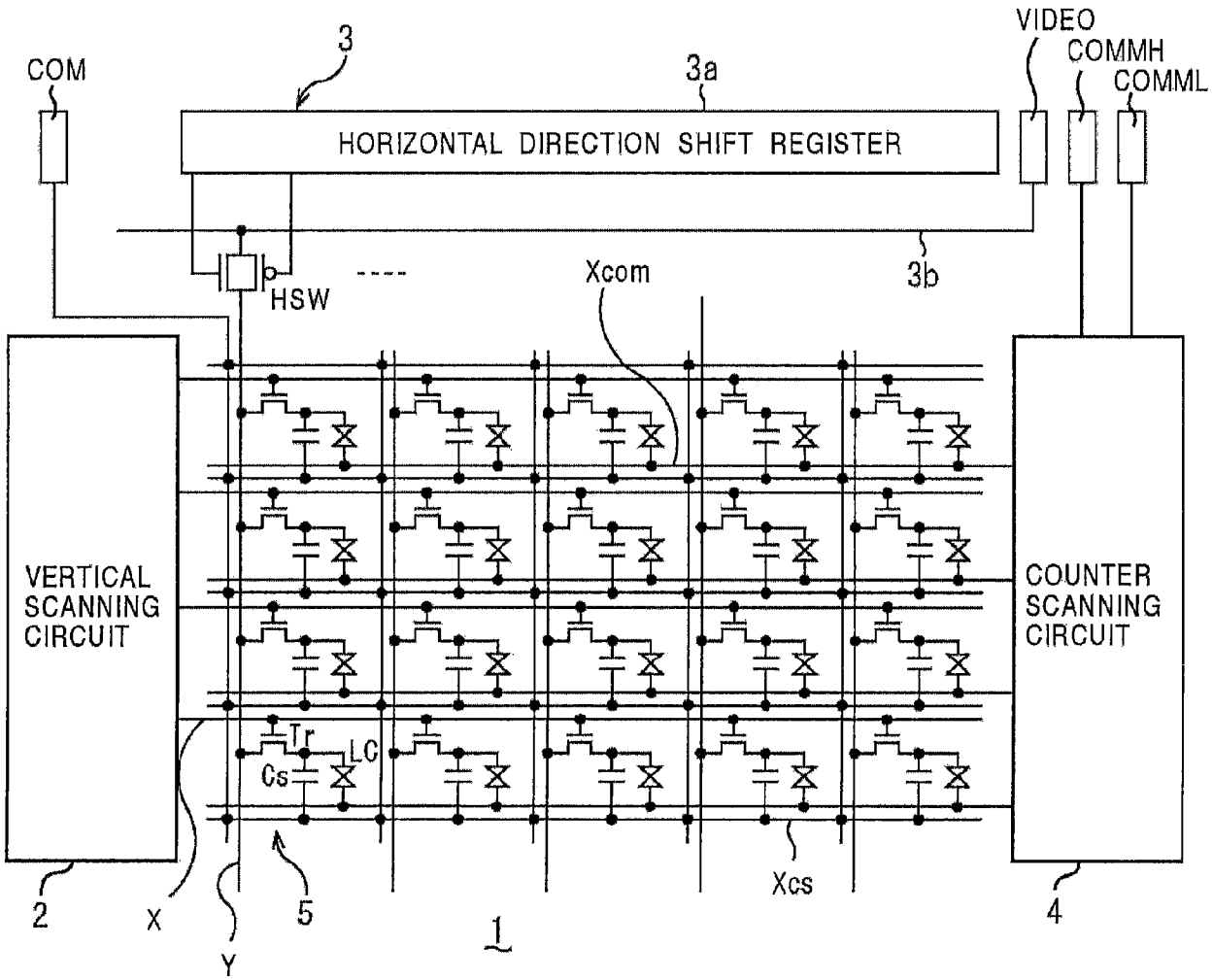
FIG. 1 is a circuit block diagram showing the entire structure of a display apparatus according to the present invention.

Embodiments of the present invention will be described with reference to the drawings. FIG. 1 is a circuit block diagram showing the entire structure of a display apparatus according to the present invention. Referring to FIG. 1, the display apparatus basically includes a pixel array unit 1, a vertical scanning circuit 2, and a horizontal driving circuit 3. The pixel array unit 1 includes scanning lines X arranged in rows, signal lines Y arranged in columns, and pixels 5 arranged in a matrix form in association with intersections of the scanning lines X and the signal lines Y. The vertical scanning circuit 2 includes a shift register and the like and is arranged in one side of the pixel array unit 1 to drive the pixel array unit 1. The vertical scanning circuit 2 sequentially applies a selection pulse to each of the scanning lines X so as to sequentially select the pixels 5 row by row. The horizontal driving circuit 3 applies a signal VIDEO whose polarity inverts between high (H) and low (L) with respect to a predetermined reference potential COM to each of the signal lines Y, and writes the signal VIDEO whose polarity is H or L in the pixels 5 of a selected row. More specifically, the horizontal driving circuit 3 includes a horizontal direction shift register 3*a* and a horizontal switch HSW. The horizontal switch HSW is arranged at an end of each of the signal lines Y, and each of the signal lines Y is connected to a common video line 3*b*. An AC inversion signal VIDEO is externally supplied to the video line 3*b*. The horizontal direction shift register 3*a* sequentially opens and closes the horizontal switch HSW so as to sample the signal VIDEO at each of the signal lines.

Each of the pixels 5 includes a transistor Tr functioning as a switching element; and a pixel electrode. The transistor Tr is, for example, a field-effect thin-film transistor. The transistor Tr is connected to the corresponding scanning line X and signal line Y and is switched on in accordance with the selection pulse. A signal is written in the pixel electrode via the switched-on transistor Tr. This signal is sampled at the signal line Y via the horizontal switch HSW by the horizontal driving circuit 3.

The display apparatus further includes a counter electrode arranged facing the pixel electrodes with predetermined spaces therebetween and electro-optic materials held in the spaces between the pixel electrodes and the counter electrode. The optical characteristics of the electro-optic materials change based on potential differences between the pixel electrodes and the counter electrode. In this embodiment, the electro-optic materials are liquid crystal. The liquid crystal is held between the pixel electrodes and the counter electrode, and liquid crystal cells LCs are formed for respective pixels.

The present invention is characterized in that the counter electrode includes row counter electrodes Xcoms divided based on the rows of the pixels 5. In order to drive and scan the row counter electrodes Xcoms, a counter scanning circuit 4 is provided. The counter scanning circuit 4 sequentially scans the row counter electrodes Xcoms in accordance with a pixel row sequentially selected by the vertical scanning circuit 2, and applies any one of a counter potential COMMH at H level and a counter potential COMML at L level that invert with respect to the reference potential COM. At this time, when the horizontal driving circuit 3 writes a signal of one polarity in a selected pixel row, the counter scanning circuit 4 applies a counter potential, which has an opposite polarity, to row counter electrodes Xcoms corresponding to the selected pixel row, and the row counter electrodes Xcoms are kept at the counter potential having the opposite polarity during a period from cancellation of selection of the pixel row to the next selection of a pixel row. For example, when the horizontal driving circuit 3 writes a signal VIDEO of an H polarity in a selected pixel row, the counter scanning circuit 4 applies a counter potential COMML, which has an opposite polarity, to row counter electrodes Xcoms corresponding to the selected pixel row, and the row counter electrodes Xcoms are kept at the counter potential COMML having the opposite polarity during a period from cancellation of selection of the pixel row to the next selection of a pixel row. On the other hand, when the horizontal driving circuit 3 writes a signal of an L polarity in a selected pixel row, the counter scanning circuit 4 applies a counter potential COMMH, which has an opposite polarity, to corresponding row counter electrodes Xcoms. The counter scanning circuit 4 is formed on a pixel substrate, together with the vertical scanning circuit 2 and the horizontal driving circuit 3. Connecting wiring for scanning to the row counter electrodes Xcoms on a counter substrate enables scanning. However, the present invention is not limited to this. The counter scanning circuit 4 may be arranged on the counter substrate so that the row counter electrodes Xcoms can be directly driven and scanned.

Figure 6:
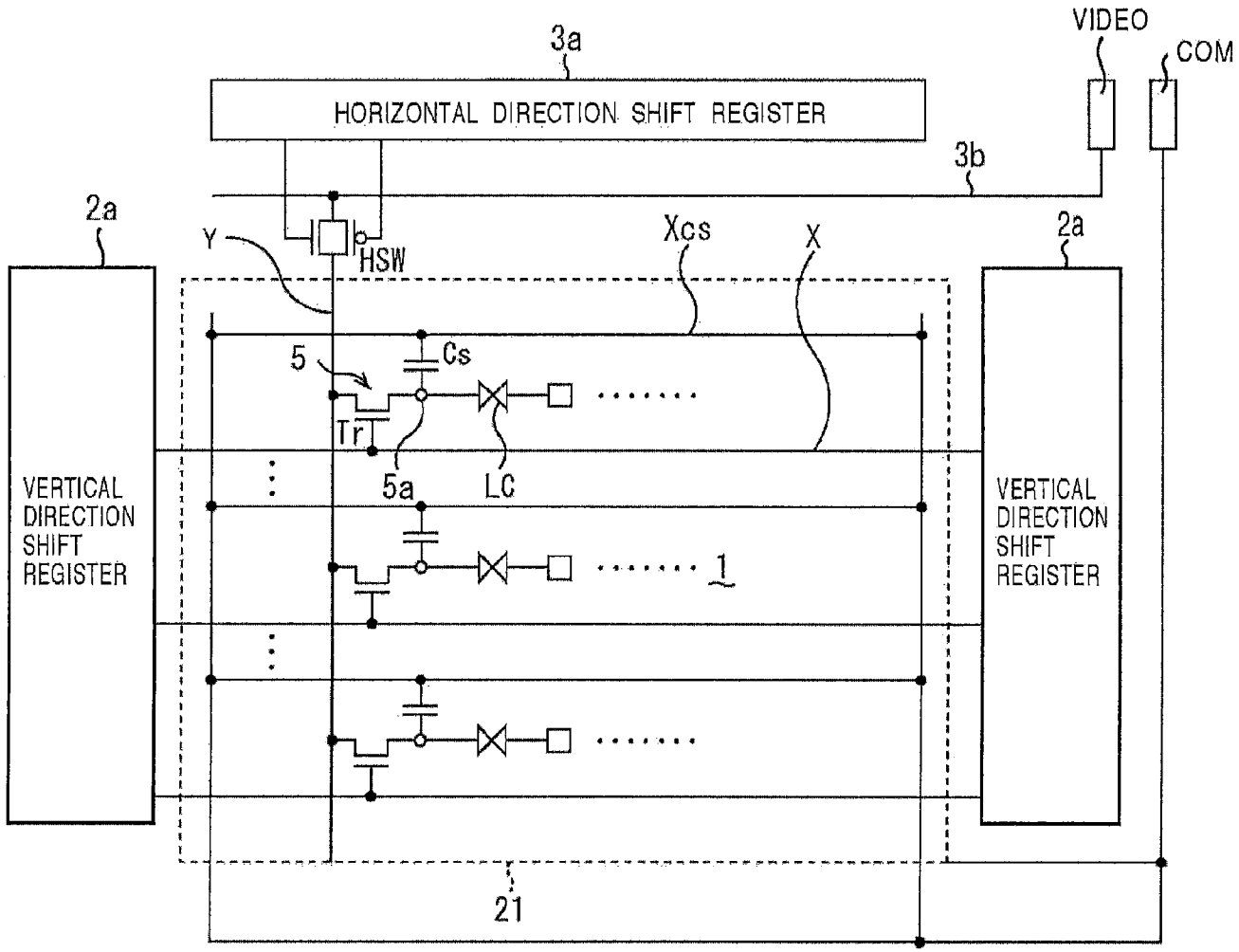
FIG. 6 PRIOR ART
FIG. 6 is a circuit block diagram showing an example of a known display apparatus.

In this embodiment, 1 H inversion driving is adopted. In other words, the horizontal driving circuit 3 writes a signal VIDEO whose polarity inverts row by row in each pixel. In accordance with this, the counter scanning circuit 4 applies a counter potential COMMH or COMML whose polarity inverts row by row and whose polarity is opposite to the signal VIDEO in each row counter electrode Xcom. In this embodiment, each of the pixels 5 further includes an auxiliary capacitor Cs for holding the signal VIDEO written in the pixel electrode, in addition to the transistor functioning as a switching element and the liquid crystal cell LC. One electrode of the auxiliary capacitor Cs is connected to the corresponding transistor Tr and the other electrode of the auxiliary capacitor Cs is fixed at the reference potential COM via an auxiliary capacitor line Xcs. Although, in the example shown in FIG. 1, the vertical scanning circuit 2 is arranged in only one side of the scanning lines X arranged in rows to drive the scanning lines X from the one side, the present invention is not necessarily limited to this arrangement. As in the known example shown in FIG. 6, a pair of vertical scanning circuits may be arranged in both sides of the scanning lines X to drive the scanning lines X from both sides at the same time. Also, although the counter scanning circuit 4 is arranged in one side of the row counter electrodes Xcoms to drive the row counter electrodes Xcoms from the one side in FIG. 1, the present invention is not limited to this. Similarly to the vertical scanning circuits, a pair of counter scanning circuits may be arranged in both sides of the row counter electrodes Xcoms to drive the row counter electrodes Xcoms from both sides at the same time.

Figure 2:
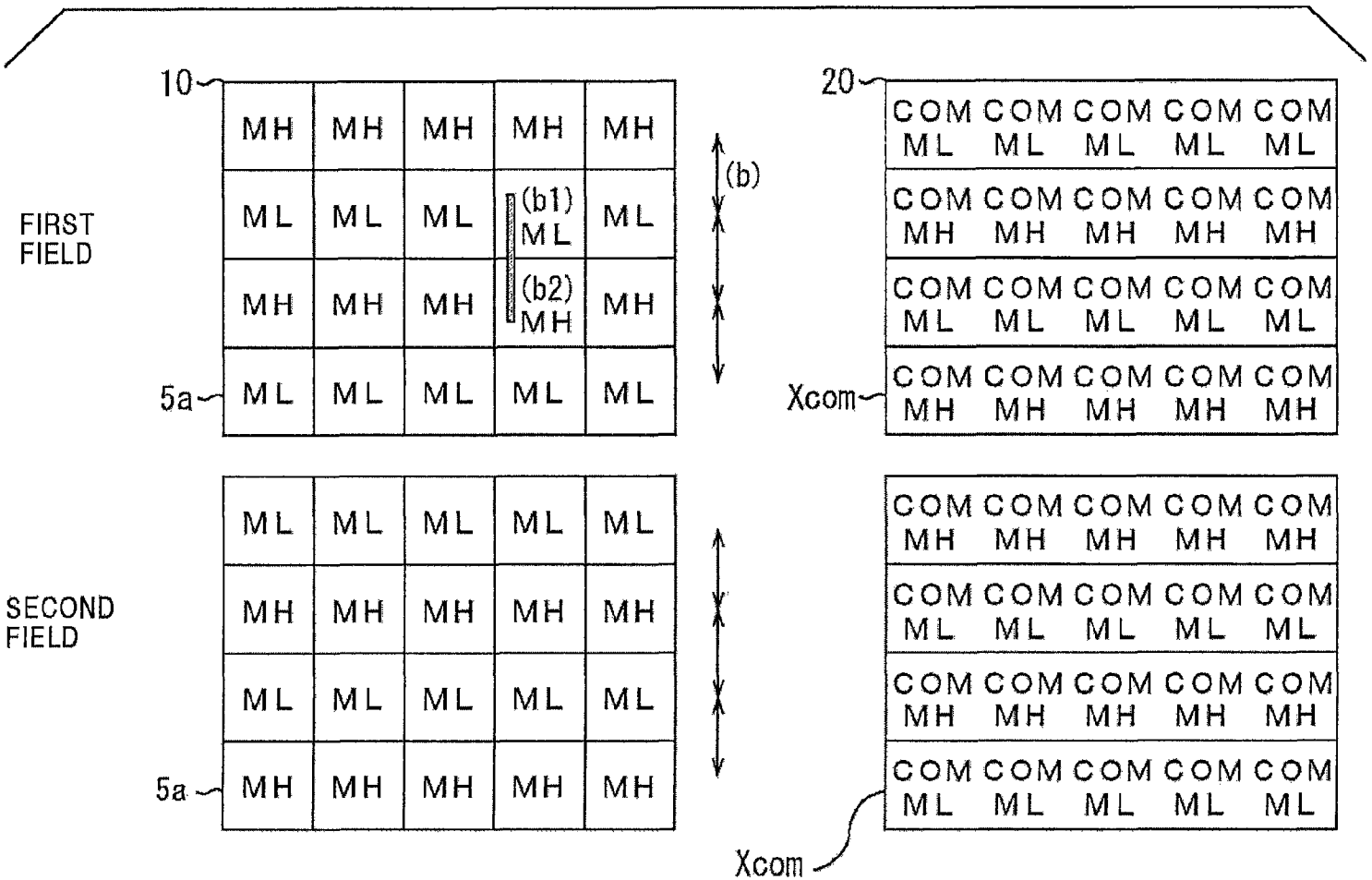
FIG. 2 is a schematic diagram showing a driving method for the display apparatus according to the present invention.

FIG. 2 is a schematic diagram showing a driving method for the display apparatus shown in FIG. 1. The driving method adopts 1 H inversion driving and 1 F inversion driving. When attention is focused on a pixel substrate 10 in the first field, at the first 1 H period, a signal of MH level is written in the pixel electrodes 5*a* in the first row. The level of the MH signal is 7.5 to 2.5 V. Since this level is cut by half compared with the known example, this level is represented by MH (the letter "M" is added) in order to be distinguished from the known example. For other potential levels, the letter "M" is also added in order to be distinguished from the known example. In the second row, a signal potential of ML level, which is an opposite polarity, is written. The level of the ML signal is 2.5 to 7.5 V. A lateral electric field of at most 5 V is applied to a space (b) between the pixel electrodes 5*a* in the first row and the pixel electrodes 5*a* in the second row. This value is reduced by half compared with the known example.

The counter substrate 20 in the first field performs 1 H inversion driving for the row counter electrodes Xcoms in accordance with 1 H inversion driving performed on the pixel substrate 10. However, the phase for the pixel substrate 10 is different from the phase for the counter substrate 20. For example, on the counter substrate 20, a counter potential having COMML level is applied to the row counter electrodes Xcoms in the first row and this potential is kept during one field. In this embodiment, the counter potential having COMML level is fixed to 2.5 V. A counter potential having COMMH level is applied to the row counter electrodes Xcoms in the second row, and this potential is kept during one field. In this embodiment, the counter potential having COMMH level is fixed to 7.5 V.

In the second field, 1 H inversion driving is performed on the pixel substrate 10 and the counter substrate 20. However, the phase is different between the first field and the second field, and so-called 1 F inversion driving is performed. For example, when attention is focused on the pixel substrate 10, a signal potential of ML level is written in the pixel electrodes 5*a* in the first row. On the counter substrate 20, a counter potential of COMMH level having an opposite polarity, which is 7.5 V, is applied and held. In the second row, a signal of MH level is written on the pixel substrate 10, and in contrast, a counter potential of COMML level having an opposite polarity is applied and held on the counter substrate 20.

As described above, in the present invention, a counter electrode on the counter substrate 20 is also divided row by row. A counter potential whose phase is opposite to a signal input on the pixel substrate 10 is applied to each of the row counter electrodes Xcoms, and scanning is performed row by row in synchronization with writing in the pixels 5. Amplitude of an input potential of a signal is reduced to 7.5 to 2.5 V, and instead of this, the potential of the counter electrodes is fixed to 7.5 or 2.5 V. A signal amplitude of 5.0, which is the same as the known example, is ensured for the pixel part. Although the row counter electrodes Xcoms are patterned in a band form in the example shown in FIG. 2, the present invention is not limited to this. As in the pixel electrodes 5*a* on the pixel substrate 10, the row counter electrodes Xcoms may be patterned in a grid form or a matrix form. However, if the row counter electrodes Xcoms are patterned in the matrix form, the row counter electrodes Xcoms must be commonly connected for each row so that scanning can be performed by the counter scanning circuit 4.

Figure 3A:
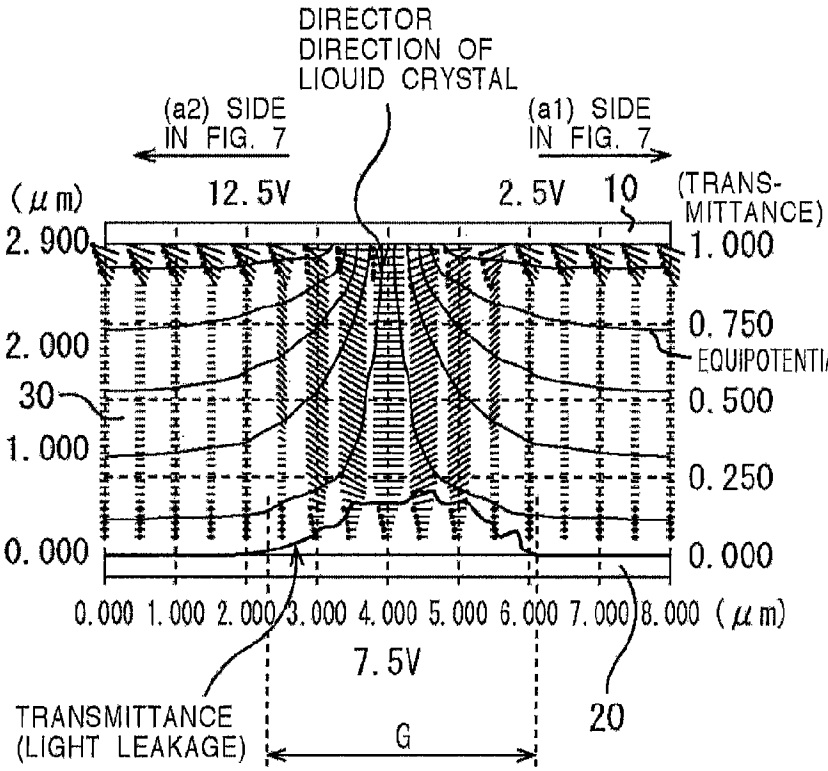
FIG. 3A PRIOR ART
FIGS. 3A and 3B are cross-sectional views showing the distribution of transmittance and equipotential lines in the display apparatus according to the present invention.
Figure 3B:
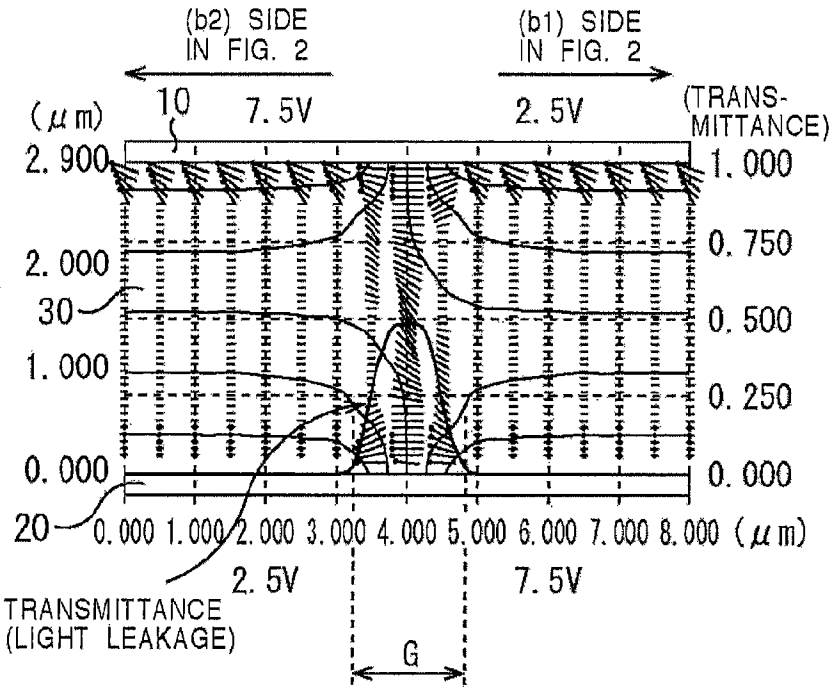

FIGS. 3A and 3B show results of simulation of distribution of the transmittance of liquid crystal and electric lines of force in a pixel part. FIG. 3A shows results of simulation for a known liquid crystal display apparatus. FIG. 3B shows results of simulation for the display apparatus according to the present invention. For the sake of convenience of simulation, the pixel substrate 10 is displayed at the upper side, and the counter substrate 20 is displayed at the lower side. In FIGS. 3A and 3B, a vertical distance (μm) between the pixel substrate 10 and the counter substrate 20 is represented at the left side, the transmittance is represented at the right side, and a lateral distance (μm) is represented at the lower side. The space between the pixel substrate 10 and the counter substrate 20 is approximately 3 μm, and liquid crystal 30 is held in the space between the pixel substrate 10 and the counter substrate 20. In FIGS. 3A and 3B, a director direction of liquid crystal, transmittance, and equipotential lines are shown.

Figure 7:
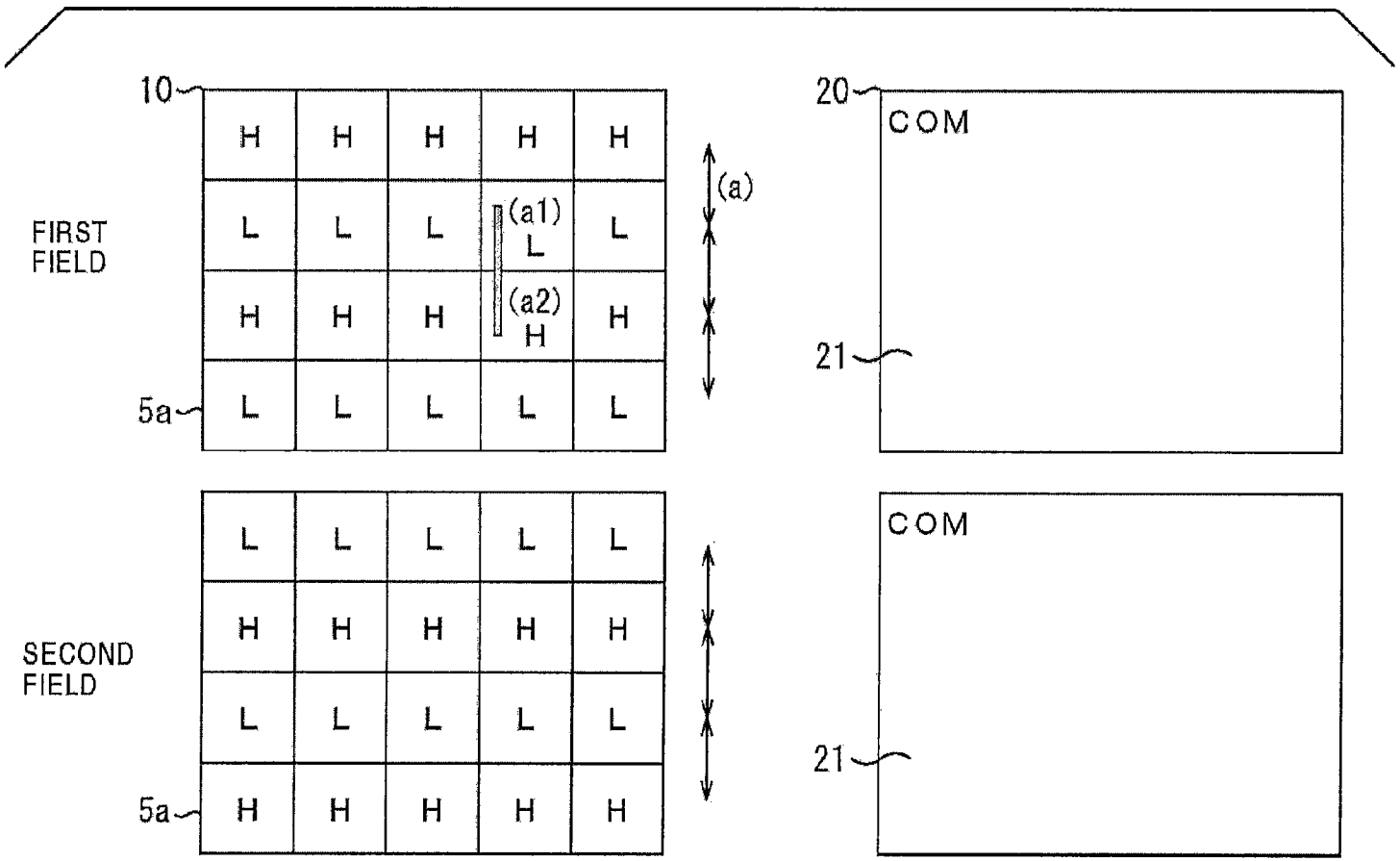
FIG. 7 PRIOR ART
FIG. 7 is a schematic diagram showing a driving method for the known display apparatus shown in FIG. 6.

In the known driving method shown in FIG. 3A, a cross section taken along a line connecting a1 and a2 in FIG. 7 is shown. In this part, a lateral electric field of at most 10.0 V (12.5−2.5 V=10.0 V) is applied. Thus, the orientation of the liquid crystal 30 is disordered, and a light leakage area G is large, such as approximately slightly less than 4 μm.

In contrast, in the driving method according to the present invention shown in FIG. 3B, in a cross section taken along a line connecting b1 and b2 in FIG. 2, a lateral electric field between the pixels on the pixel substrate 10 is at most 5.0 V (7.5-2.5 V=5.0 V), which is reduced by half compared with the intensity of the lateral electric field according to the known example. Thus, disorder of liquid crystal molecules is reduced, and the light leakage area G is significantly reduced compared with the case shown in FIG. 3A, and the light leakage area (G) is approximately slightly less than 2 μm. An area in which light leakage does not occur can be used for pixel opening. Thus, the transmittance can be improved.

Figure 4:
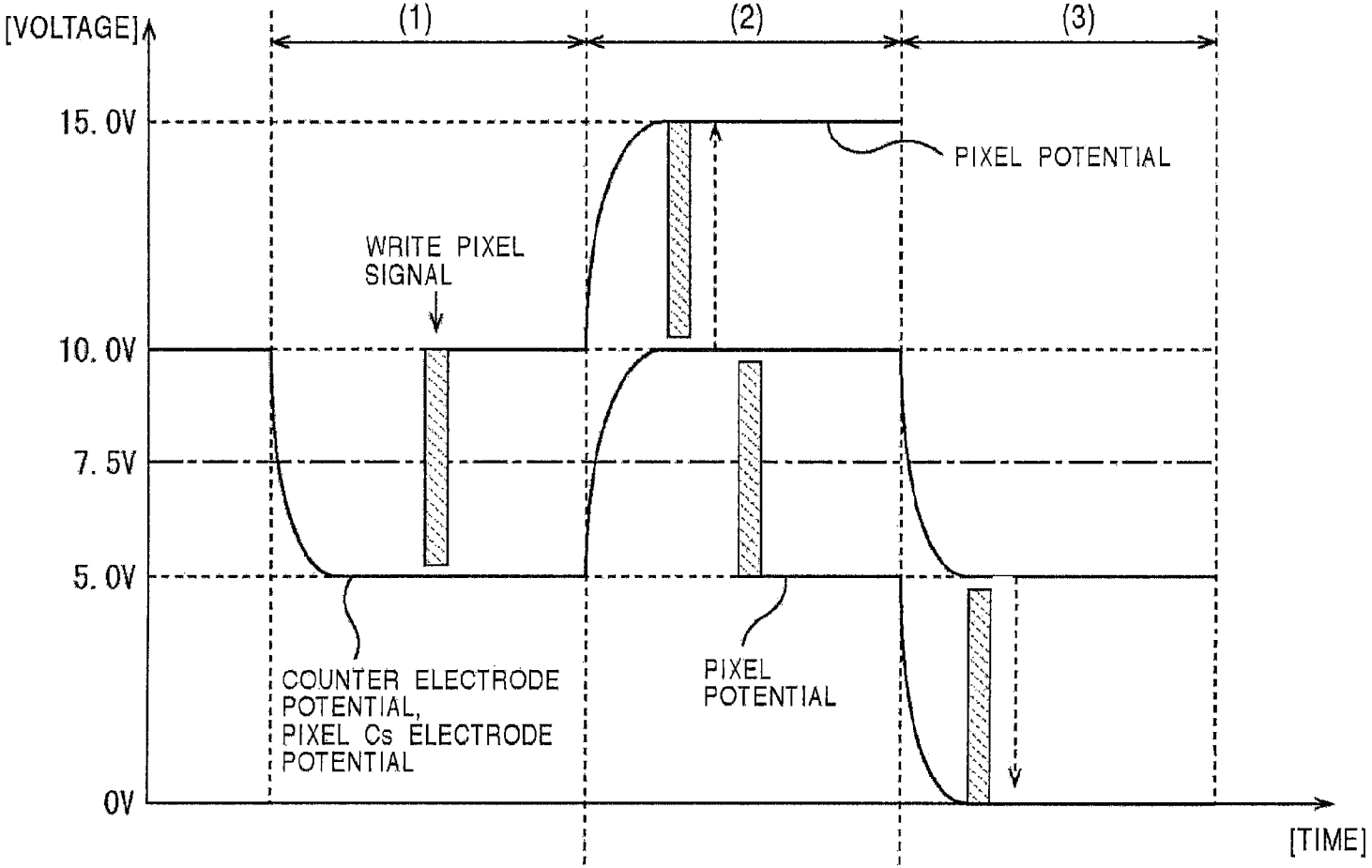
FIG. 4 PRIOR ART
FIG. 4 is a timing chart showing a known VCOM inversion driving method.

In order to reduce the amplitude of signal input, VCOM inversion driving has generally been adopted as a method for changing the potential of a counter electrode, as described above. However, in the known VCOM inversion driving method, when counter electrode potential VCOM changes, an auxiliary capacitor potential in a pixel part is changed based on the change of the potential VCOM, and this increases the pixel potential itself. Thus, withstand pressure necessary for the whole panel is increased. FIG. 4 shows changes in the potential of pixel electrodes, a counter electrode, and auxiliary capacitor electrodes in two rows in the known VCOM inversion driving. Although these electrodes exhibit opposite polarity in the next field, this is not illustrated. In the VCOM inversion driving, the counter electrode potential and the pixel Cs electrode potential invert every 1 H period in conjunction with each other. In the first H period (1), the counter electrode potential is at L level, and in contrast, a pixel signal of H level is written. In the second H period (2), the counter electrode potential inverts to H level. Since the gates of the pixels in which the image signal is written at the first H period (1) are closed, upward shift of the counter electrode potential and the pixel Cs electrode potential that is conjunction with the counter electrode potential moves the pixel potential upward. In the second H period (2), a pixel signal of a negative polarity is written in the next pixel row. Then, in the third H period (3), the counter electrode potential inverts again to L level. Since the gates of the pixels in which the signal is written at the second H period (2) are closed, downward shift of the Cs electrode potential and the counter electrode potential moves the pixel potential downward. Accordingly, in the known VCOM inversion driving, the counter electrode potential is the same as the auxiliary capacitor electrode potential, and the pixel potential is moved upward or downward in accordance with a change after the H period in which a signal is written. Thus, power supply voltage of a larger range is required. In the example shown in FIG. 4, power supply voltage between less than 0 V and more than 15.0 V is required.

Figure 5:
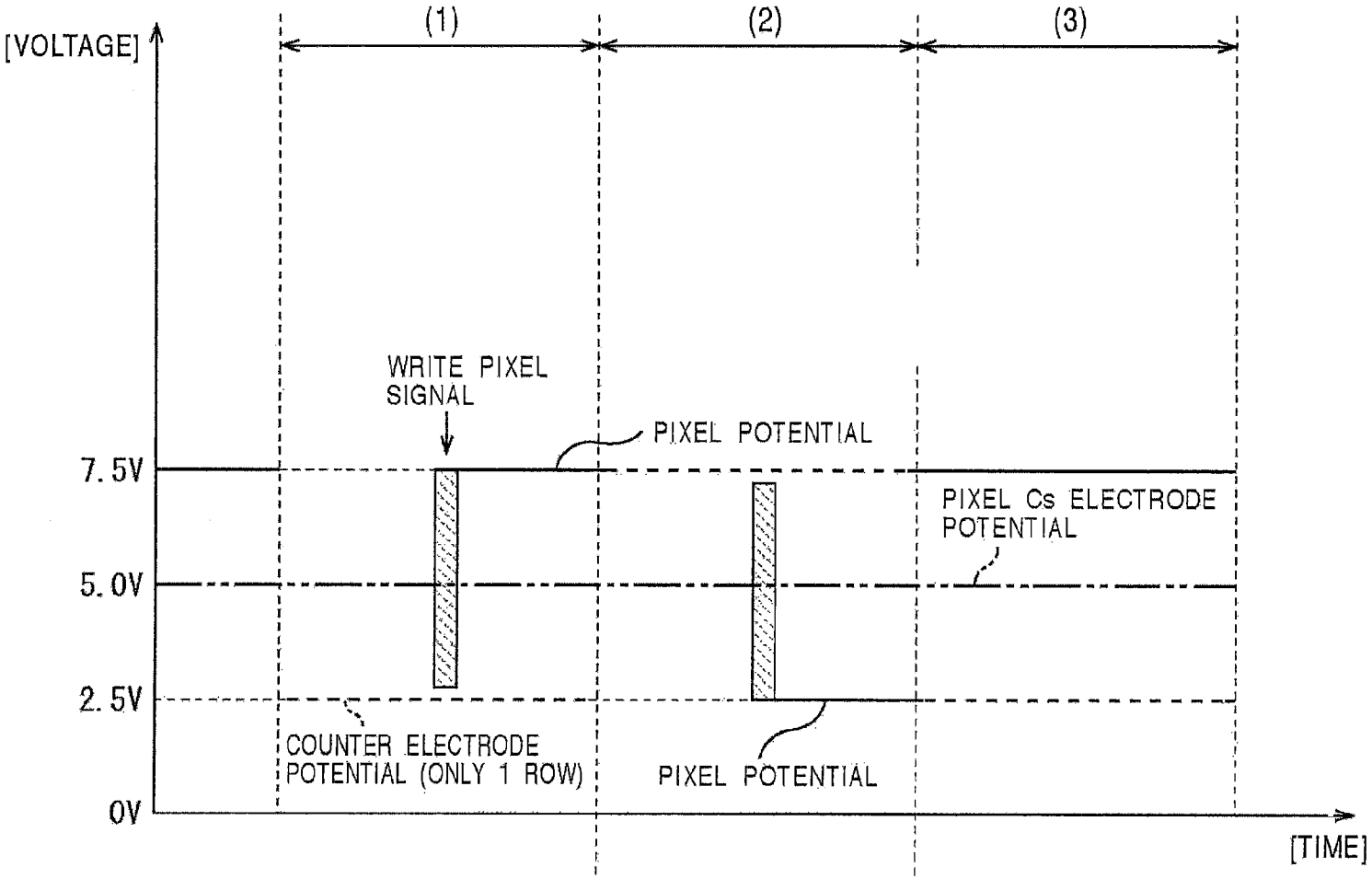
FIG. 5 is a timing chart showing the driving method according to the present invention.

FIG. 5 shows changes in the potential of pixel electrodes, a counter electrode, and auxiliary capacitor electrodes in two rows in the display apparatus according to the present invention. For easy understanding, parts corresponding to parts shown in the potential diagram for the VCOM inversion driving in FIG. 4 are represented by corresponding reference numerals. At the first H period (1), a signal of MH level is written in pixels in a selected row. At this time, the potential of the corresponding row counter electrodes is scanned at COMML level. This potential is kept during one field. At the second H period (2), the signal is switched to a potential of ML level, and in contrast, a counter potential applied to the row counter electrodes is at COMMH level. The counter electrode potential once scanned and set at the second H period (2) is kept fixed during one field. In contrast, the pixel Cs electrode potential is always fixed to a reference potential, which is an intermediate level. In the driving method according to the present invention, row counter electrodes are scanned row by row, and the potential is maintained during one field. Thus, a pixel part exhibits a small change, and only a very small range is necessary for a power supply voltage. In the example shown in FIG. 5, the range of the power supply voltage is between less than 2.5 V and more than 7.5 V. This is because that the row counter electrodes are scanned row by row and the potential is fixed to COMMH (7.5 V) or COMML (2.5 V) during one field. This point is greatly different from the known VCOM inversion driving.

In the driving method for the display apparatus according to the present invention, the potential of pixels is in a range between COMML (2.5 V) and COMMH (7.5 V), and the signal amplitude itself is also within this range. Thus, a potential difference between pixel electrodes and signal lines can be significantly reduced, and leakage of pixel transistors can be significantly reduced. The driving method according to the present invention is resistant to light leakage. Furthermore, reducing the amplitude of an input video signal causes a reduction in the influence of noise inserted into pixel electrodes from signal lines via parasitic capacitance. Thus, inferior image quality, such as ghost images, blurring of a borderline when a window is displayed, and the like, can be significantly reduced.

What is claimed is:

1. A display apparatus comprising:

a first-row counter electrode configured to be fixed at a first-row counter potential during a first time period, said first-row counter potential being a voltage greater than 0 volts;

a first-row pixel electrode electrically connected to an electrode of a first-row auxiliary capacitor, an electro-optic material being between said first-row counter electrode and said first-row pixel electrode;

a capacitor line configured to be fixed at a reference potential, another electrode of the first-row auxiliary capacitor being electrically connected to said capacitor line;

a first-row transistor configurable to transfer a pixel signal from a signal line to said first-row pixel electrode, a signal amplitude of the pixel signal during said first time period being changeable to a first pixel potential;

a second-row pixel electrode electrically connected to an electrode of a second-row auxiliary capacitor, another electrode of the second-row auxiliary capacitor being electrically connected to said capacitor line;

a second-row counter electrode configured to be fixed at a second-row counter potential during a second time period, said second-row counter potential being said voltage higher than the reference potential;

a second-row transistor configurable to transfer said pixel signal from said signal line to said second-row pixel electrode, said signal amplitude of the pixel signal during said second time period being changeable to a second pixel potential;

a vertical scanning circuit configured to output a first-row selection pulse only during said first time period and to output a second-row selection pulse only during said second time period, wherein said first pixel potential is a voltage higher than the reference potential, said reference potential being a voltage higher than the first-row counter potential.

2. The display apparatus according to claim 1, wherein said first-row pixel electrode is directly electrically connected to said electrode of the first-row auxiliary capacitor.

3. The display apparatus according to claim 1, wherein said another electrode of the first-row auxiliary capacitor is directly electrically connected to said capacitor line.

4. The display apparatus according to claim 1, wherein said first-row transistor is configurable to provide an electrical connection and disconnection between said signal line and said first-row pixel electrode.

5. The display apparatus according to claim 1, wherein said first time period is a horizontal period of a field.

6. The display apparatus according to claim 1, wherein said second-row pixel electrode is directly electrically connected to said electrode of the second-row auxiliary capacitor.

7. The display apparatus according to claim 1, wherein said another electrode of the second-row auxiliary capacitor is directly electrically connected to said capacitor line.

8. The display apparatus according to claim 1, wherein said electro-optic material is between said second-row pixel electrode and said second-row counter electrode.

9. The display apparatus according to claim 1, wherein said signal amplitude of the pixel signal is changeable to said first pixel potential during said first time period, said signal amplitude of the pixel signal being changeable to said second pixel potential during said second time period.

10. The display apparatus according to claim 1, wherein said second-row transistor is configurable to provide an electrical connection and disconnection between said signal line and said second-row pixel electrode.

11. The display apparatus according to claim 1, wherein said second-row counter potential is said voltage higher than the reference potential, said second pixel potential being a voltage lower than the reference potential.

12. The display apparatus according to claim 1, wherein said second-row pixel electrode is directly electrically connected to said electrode of the second-row auxiliary capacitor.

13. The display apparatus according to claim 1, wherein said another electrode of the second-row auxiliary capacitor is directly electrically connected to said capacitor line.

14. A display apparatus comprising:

a first-row counter electrode configured to be fixed at a first-row counter potential during a first time period, said first-row counter potential being a voltage greater than 0 volts;

a first-row pixel electrode electrically connected to an electrode of a first-row auxiliary capacitor, an electro-optic material being between said first-row counter electrode and said first-row pixel electrode;

a capacitor line configured to be fixed at a reference potential, another electrode of the first-row auxiliary capacitor being electrically connected to said capacitor line;

a first-row transistor configurable to transfer a pixel signal from a signal line to said first-row pixel electrode, a signal amplitude of the pixel signal during said first time period being changeable to a first pixel potential;

a second-row pixel electrode electrically connected to an electrode of a second-row auxiliary capacitor, another electrode of the second-row auxiliary capacitor being electrically connected to said capacitor line;

a second-row counter electrode configured to be fixed at a second-row counter potential during a second time period, said second-row counter potential being said voltage higher than the reference potential, wherein said first-row selection pulse controls a transfer of the pixel signal from said signal line to said first-row pixel electrode, said second-row selection pulse controlling a transfer of the pixel signal from said signal line to said second-row pixel electrode, wherein said first pixel potential is a voltage higher than the reference potential, said reference potential being a voltage higher than the first-row counter potential.

15. A display apparatus comprising:

a first-row counter electrode configured to be fixed at a first-row counter potential during a first time period, said first-row counter potential being a voltage greater than 0 volts;

a first-row pixel electrode electrically connected to an electrode of a first-row auxiliary capacitor, an electro-optic material being between said first-row counter electrode and said first-row pixel electrode;

a capacitor line configured to be fixed at a reference potential, another electrode of the first-row auxiliary capacitor being electrically connected to said capacitor line;

a first-row transistor configurable to transfer a pixel signal from a signal line to said first-row pixel electrode, a signal amplitude of the pixel signal during said first time period being changeable to a first pixel potential;

a second-row pixel electrode electrically connected to an electrode of a second-row auxiliary capacitor, another electrode of the second-row auxiliary capacitor being electrically connected to said capacitor line;

a second-row counter electrode configured to be fixed at a second-row counter potential during a second time period, said second-row counter potential being said voltage higher than the reference potential;

a second-row transistor configurable to transfer said pixel signal from said signal line to said second-row pixel electrode, said signal amplitude of the pixel signal during said second time period being changeable to a second pixel potential, wherein said first pixel potential is a voltage higher than the reference potential, said reference potential being a voltage higher than the first-row counter potential, wherein:

said voltage higher than the reference potential=7.5V;

said reference potential=5.0V;

said voltage lower than the reference potential=2.5V.

* * * * *